US007520817B2

(12) United States Patent
Sullivan

(10) Patent No.: US 7,520,817 B2
(45) Date of Patent: Apr. 21, 2009

(54) BILLIARD CUE TIPS AND METHODS OF ASSEMBLY

(75) Inventor: Robert G. Sullivan, New Albany, IN (US)

(73) Assignee: Diamond Billiard Products, Inc., Jeffersonville, IN (US)

( * ) Notice: Subject to any disclaimer, the term of this patent is extended or adjusted under 35 U.S.C. 154(b) by 0 days.

(21) Appl. No.: 11/376,487

(22) Filed: Mar. 15, 2006

(65) Prior Publication Data

US 2007/0219009 A1 Sep. 20, 2007

Related U.S. Application Data

(60) Provisional application No. 60/667,020, filed on Mar. 30, 2005.

(51) Int. Cl.
*A63D 15/12* (2006.01)

(52) U.S. Cl. ..... 473/49

(58) Field of Classification Search ..... 473/44–49
See application file for complete search history.

(56) References Cited

U.S. PATENT DOCUMENTS

| | | | | | |
|---|---|---|---|---|---|
| 825,096 | A * | 7/1906 | Wing | ..... | 473/49 |
| 1,340,395 | A * | 5/1920 | Leger | ..... | 473/49 |
| 1,390,331 | A * | 9/1921 | Bensinger | ..... | 473/49 |
| 1,544,696 | A * | 7/1925 | Sprenkel | ..... | 473/49 |
| 1,558,740 | A * | 10/1925 | Mallory | ..... | 473/49 |
| 1,648,613 | A * | 11/1927 | Grenier | ..... | 473/49 |
| 1,660,707 | A * | 2/1928 | Ford | ..... | 473/49 |
| 3,580,576 | A | 5/1971 | Merola | | |
| 3,598,409 | A | 8/1971 | Nemecek | | |
| 3,695,611 | A | 10/1972 | Lower et al. | | |
| 5,016,877 | A | 5/1991 | Lowery | | |
| 5,411,441 | A | 5/1995 | Detka | | |
| 5,462,490 | A | 10/1995 | Donwen | | |
| 5,743,803 | A | 4/1998 | Jordan et al. | | |
| 6,110,051 | A | 8/2000 | McCarty et al. | | |
| 6,183,371 | B1 | 2/2001 | Wethered | | |
| 6,582,317 | B2 | 6/2003 | Pechauer et al. | | |
| 6,719,638 | B2 | 4/2004 | Wethered | | |
| 6,840,867 | B1 | 1/2005 | Chang | | |
| 6,881,153 | B2 | 4/2005 | Andrews | | |
| 6,890,264 | B2 | 5/2005 | Verona | | |
| 7,040,996 | B2 | 5/2006 | Grandin | | |
| 2001/0051546 | A1 * | 12/2001 | Wethered | ..... | 473/44 |
| 2002/0072423 | A1 | 6/2002 | Pot | | |
| 2003/0166419 | A1 | 9/2003 | Gulyassy | | |
| 2004/0009822 | A1 | 1/2004 | McCarty | | |
| 2004/0018882 | A1 | 1/2004 | Church et al. | | |
| 2006/0030416 | A1 | 2/2006 | Evans et al. | | |

* cited by examiner

*Primary Examiner*—Mark S Graham
(74) *Attorney, Agent, or Firm*—Woodard, Emhardt, Moriarty, McNett & Henry LLP

(57) ABSTRACT

An improved billiard cue construction includes a cue tip mounted on a cue tip stabilizer. The stabilizer is constructed with a convex mounting surface that can provide support to the tip and reduces the tendency of the cue tip to deform during use. The stabilizer may be integral with the billiard shaft or separately attached.

25 Claims, 6 Drawing Sheets

BILLIARD CUE TIPS AND METHODS OF ASSEMBLY

REFERENCE TO RELATED APPLICATION

This application claims the benefit of U.S. Provisional Application No. 60/667,020, filed Mar. 30, 2005, titled TWO PART POOL CUE TIP, TIP AND FERRULE SYSTEM, AND A POOL CUE ATTACHMENT SYSTEM, naming Greg Sullivan as inventor, and filed under Express Mail No. ER 826536552 US.

BACKGROUND

This application relates to billiard cue tips and methods of assembly. Traditionally, a cue tip is constructed of one or more layers of leather or other suitable material bonded to the distal end of a pool cue shaft. The cue tip is disc shaped, i.e. it is round with two flat surfaces—one of the flat surfaces is bonded to the end of the cue shaft. The now remaining "exposed" flat surface is the portion of the billiard cue that strikes the cue ball. However, "flat" is not the desired shape for the surface of a cue tip. Instead, the preferred shape is rounded or convexly curved. A rounded shape allows a player to impart "english" or spin on the cue ball to complement play. To create the rounded tip, the disc shaped cue tip is sanded until the desired "roundness" (typically the curvature of a dime or nickel) is reached. As a result of this shaping, the thickness of the cue tip varies across its surface.

Over time due to the repetitive striking of the cue ball with the billiard cue, the rounded cue tip becomes distorted—it becomes flatter and often acquires the shape of a mushroom. This condition is described as "mushrooming." To correct this condition, the player must repeatedly groom and re-shape the cue-tip. This grooming removes material from the cue tip resulting in a shorter life for the cue tip. Eventually, the cue tip must be replaced. Additionally, the cue tip may become less consistent across its surface. As a result, the consistency and playability of the billiard cue changes and a player must adjust to these changes. This adjustment is critical and could be untimely if the cue tip must be adjusted during a competition. Billiards is a game of skill. The speed and spin of the cue ball must be accurately controlled in order to not only "pocket" the desired ball, but to also strategically position the cue ball to "pocket" the next ball. Alternatively, the speed and spin is used to put the cue ball in a defensive position—where your opponent is left without a shot.

The distortion of the cue tip affects recreational players as well. Many people play billiards in public pool halls for a fee where tables, billiard cues, balls, and chalk are provided. However, the tools necessary for reshaping the cue tip often are not. As a result, a player is stuck using a cue stick with a deformed cue tip. Further, because the player is unaware of the thickness of the cue tip, the player may be unable to adequately control the cue ball while initially adjusting to the playability of the billiard cue. Due to this lack of control, games of pool take longer, and in pool halls where the players pay per game, the pool hall makes less money. More importantly, because the players struggle with their game, they have less fun.

The flat shape of a cue tip affects beginning pool players as well. Beginners who purchase a pool table for the first time will also buy new billiard cues. New billiard cues have a flat cue tip. Not knowing that the desired shape for a cue tip is round, a new player likely plays the game with the flat cue tip. Having developed an interest in pool, the player will likely begin watching pool tournaments which are frequently televised. However, the player will see the professionals control the cue ball in ways that the player can't even come close to duplicating at home. As result, the player becomes frustrated with the game because the skills are just "too difficult to develop." This is unfortunate because part of the problem extended to the improperly prepared tools used by the beginning player.

Another problem with billiard cues is the tendency of the cue tip to "fall off" the billiard cue. If this occurs during a shot, the cue stick will likely damage the felt, resulting in a costly repair. Additionally, pool halls must keep a surplus of billiard cues on the premises to compensate for the cues that are either awaiting repair or being repaired.

Therefore, there is a need for an improved billiard cue for improving the playability of a billiard cue for both novice and advanced players. There is also a need for a longer-life billiard cue.

SUMMARY

This application is directed to billiard cues, replacement cue tips, and methods of assembly.

In one aspect, an improved billiard cue includes a cue tip stabilizer and a cue tip. The stabilizer has a convex surface and the cue tip has a receiving cavity opposite its ball striking surface. The cue tip is positioned over the stabilizer with the cavity receiving the convex surface of the stabilizer. In certain refinements, the receiving cavity of the cute tip may have a concave surface that generally corresponds to the convex surface of the stabilizer. In these and other refinements, the cue tip stabilizer may be constructed of a material that is more rigid than the cue tip such that the tendency of the cue tip to deform during use is reduced.

The stabilizer may be affixed to or integral with the billiard shaft. In one refinement, the stabilizer includes a mounting portion for mounting the stabilizer to the cue tip. The mounting portion may extend circumferentially around the billiard shaft and/or the mounting portion may include an extension member that extends into a bore in the billiard shaft. The extension member may be friction fit into the bore and/or the bore or extension member may be provided with threads, grooves, textured surfaces or adhesive to secure their attachment.

These and other aspects are discussed below.

DESCRIPTION OF SELECTED EMBODIMENTS

Figure 1A:
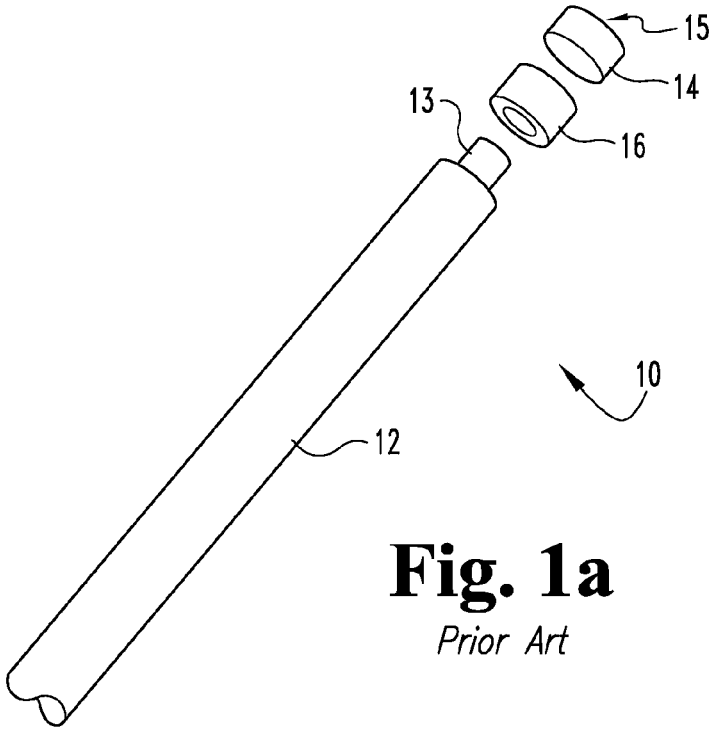
Fig. 1a Prior Art
FIG. 1*a* is an exploded perspective view of a typical prior art billiard cue.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. It will be apparent to those skilled in the art that some of the features which are not relevant to the invention may not be shown for the sake of clarity.

In one embodiment, the present invention provides an improved billiard cue construction wherein a cue tip is mounted on a cue tip stabilizer that has a convex mounting surface. The convex surface of the stabilizer provides support to the tip and helps to retain a desired shape to the tip during use.

Figure 1B:
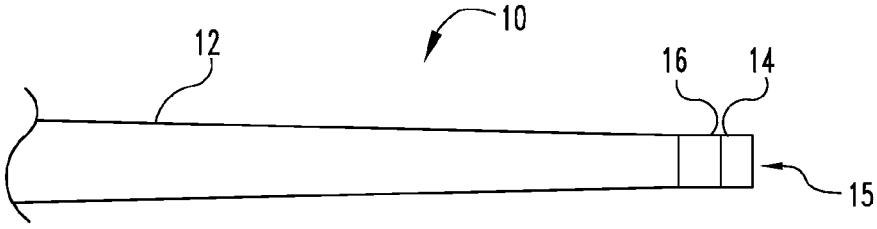
Fig. 1b Prior Art
FIG. 1*b* is a side view of the prior art billiard cue of FIG. 1*a*.
Figure 1C:
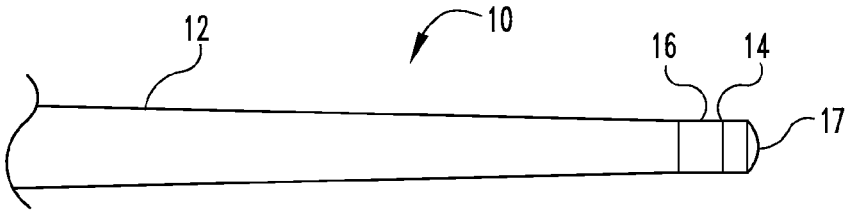
Fig. 1c Prior Art
FIG. 1*c* is a side view of the FIG. 1*a* cue with a rounded cue tip.

Referring now to the drawings, FIGS. 1*a* and 1*b* show a typical billiard cue 10. Billiard cue 10 includes a shaft 12 and a cue tip 14. Because many billiard cue shafts are made of wood or similar material, the billiard cue may also include a ferrule 16 which encloses the end of the shaft to prevent the shaft from splintering. Portion 13 of the shaft 12 enclosed by the ferrule 16 is reduced in diameter to accommodate the ferrule 16 such that the outside diameter of the assembled billiard cue 10 is smoothly tapered. The cue tip 14, which is usually a disc shaped piece of leather, is glued to the ferrule 16. The resulting billiard cue 10 has a gradually tapered shape with its narrowest point at cue tip 14. The cue tip 14 for a new billiard cue 10 is disc shaped with a striking surface 15. However, the striking surface 15 is preferably convex or rounded (the curvature of a dime or nickel) in order to impart english or spin upon the cue ball. A convex striking surface 17 is shown in FIG. 1*c*. To acquire this shape, the disc shaped piece of leather is sanded to form a rounded, convex striking surface 17 for the cue tip.

Figure 2A:
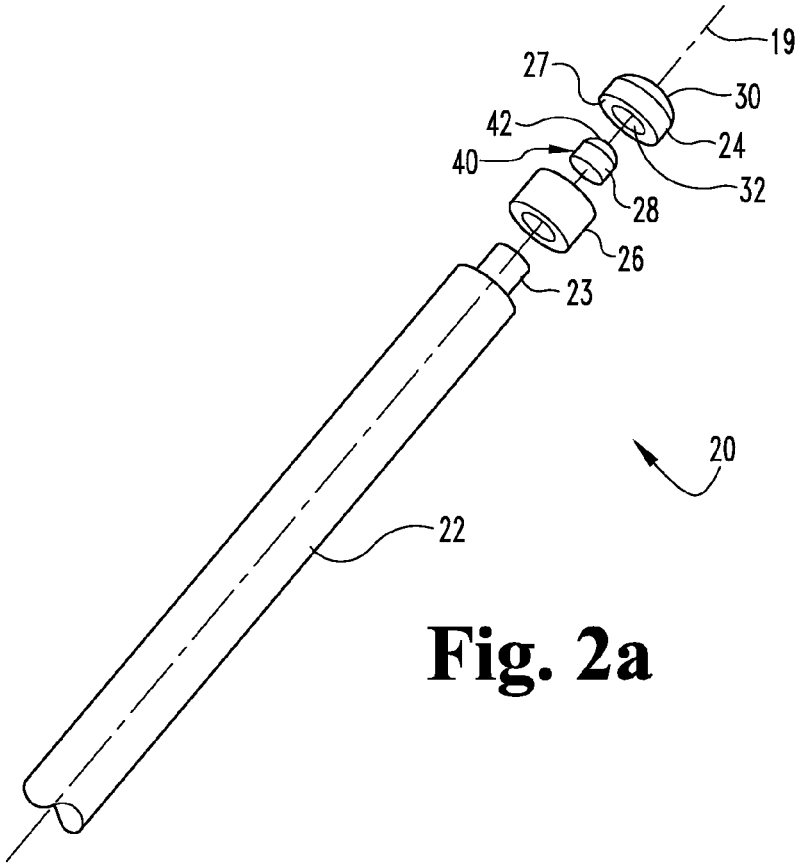
FIG. 2*a* is an exploded perspective view of one embodiment of a billiard cue according to this invention.
Figure 2B:
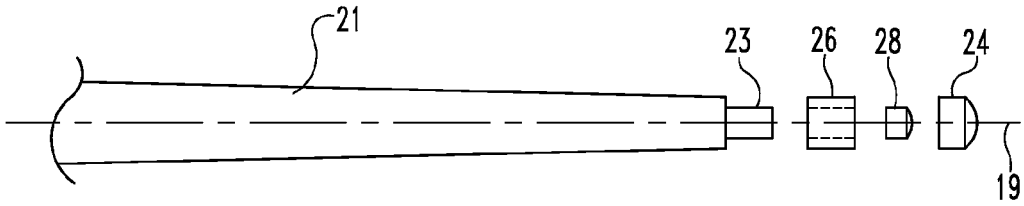
FIG. 2*b* is a side exploded view of the FIG. 2*a* embodiment.
Figure 2C:
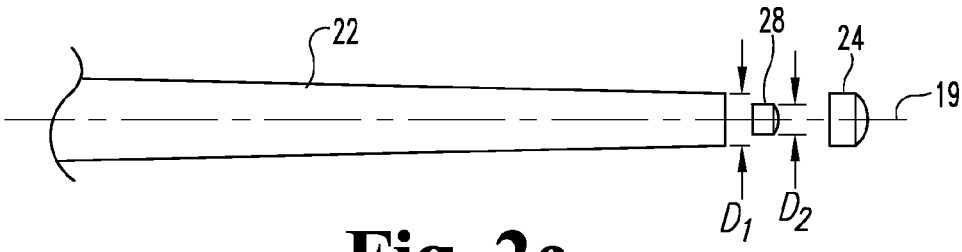
FIG. 2*c* is a side exploded view of the FIG. 2*a* embodiment without a ferrule.
Figure 3:
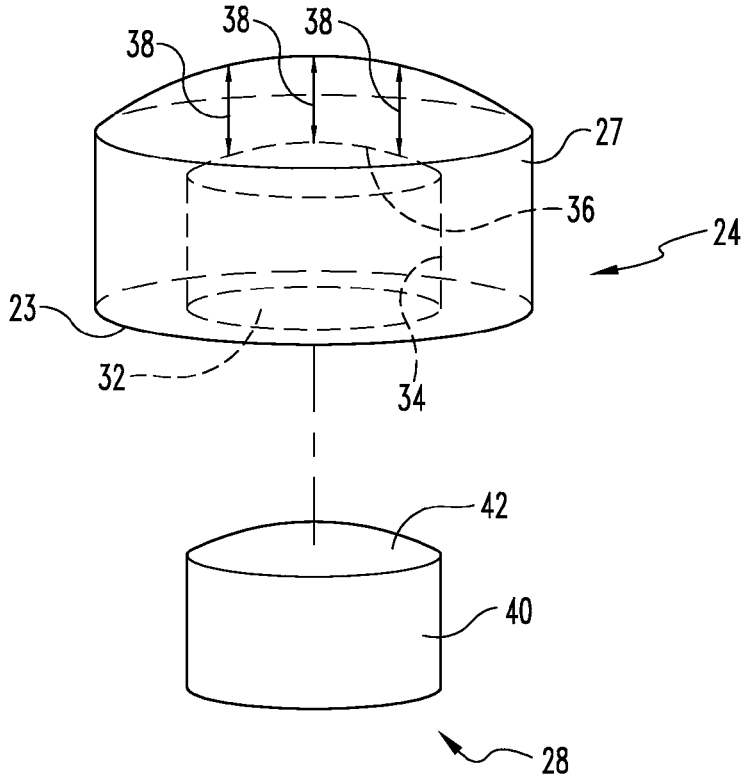
FIG. 3 is an exploded view of the cue tip stabilizer and cue tip of an embodiment according to this invention.

One embodiment of the present invention is shown in FIGS. 2*a* and 2*b*. Billiard cue 20 includes a shaft 22, a cue tip 24, a ferrule 26, and tip stabilizer 28. The shaft 22 and ferrule 26 function similarly to shaft 12 and ferrule 16 discussed above in FIG. 1. Additionally, portion 23 of shaft 22 has a reduced diameter to accommodate ferrule 26. Shaft 22 has longitudinal axis 19. In the discussion below, it is contemplated that a ferrule is optional on a billiard cue and any connection made to the ferrule may alternatively be made directly to a shaft without a ferrule 21. (See FIGS. 2*b* and 2*c*). Cue tip 24 and tip stabilizer 28 are shown in more detail in FIG. 3.

Cue tip 24 has bottom surface 25, external surface 27, and striking surface 30. Striking surface 30 can be flat or rounded (concave) but is preferably rounded to impart english or spin on the cue ball. Cue tip 24 has cavity 32 extending from and through bottom surface 25 toward striking surface 30. Cavity 32 has walls 34 extending from surface 25 which reach a striking support surface 36. Striking support surface 36 is substantially concave. Although shown as a smooth concave surface, striking support surface 36 could alternatively have multiple flat surfaces that form the substantially concave shape. Striking support surface 36 may be generally parallel to striking surface 30. Wall(s) 34 can have various shapes, including but not limited to linear, curved, or polygonal shapes, but are shown as linear to simplify the explanation. The relationship of striking support surface 36 to striking surface 30 (i.e. the thickness of the cue tip 24) can be changed to change the playing characteristics of billiard cue 20. In one embodiment, the curvature of first surface 36 corresponds with the curvature of striking surface 30 such that the thickness 38 of the cue tip 24 between the first surface 36 and the external surface 30 is substantially constant within the walls 34 of the tip shape cavity 32. Cue tip 24 may be made of any material suitable for striking a billiard cue ball, including but not limited to leather.

Referring to FIGS. 2*a*, 2*b*, 2*c*, 2*d*, and 3, cue tip stabilizer 28 is positioned within tip shape cavity 32 of cue tip 24. Cue tip stabilizer 28 has sides 40, striking support surface 42. Because cue tip stabilizer 28 is to be received within cavity 32, the sides 40 may generally correspond to walls 34 of the tip shape cavity 32 and the striking support surface 42 may have the same general shape as first surface 36. In one embodiment, the striking support surface 42, first surface 36, and striking surface 30 have approximately the same curvature. In another embodiment, the radius of curvature of surfaces 42 and 36 are about equal and both are smaller than the radius of curvature of the ball striking surface 30. The curvatures of each surface may be generally constant (i.e. a single radius of curvature for substantially the entire surface) or they may vary across the respective surface.

Tip stabilizer 28 may be constructed of materials including, but not limited to, sythentics (e.g. ABS, NYLON, DELRIN, or other machined or injection molded plastic), metals (e.g. brass, stainless steel), hardened leather, hardened epoxy or combinations thereof. The tip stabilizer 28 is preferably constructed such that it is more rigid than, and therefore provides support to, the cue tip. Typically this may be accomplished by constructing the stabilizer from a material having a hardness that is greater than the hardness of the cue tip 24. For example, the surface 42 of stabilizer 28 may be 10%, 25%, 50%, 100%, or 500% harder than the tip 24. Alternatively, it may be possible to construct the stabilizer 28 out of a material that is more resilient than the tip 24, for example to provide a different playing experience to the user. In still further alternatives, an intermediate material may be provided between the stabilizer 28 and the tip 24, for example an epoxy used to secure the tip to the stabilizer, and this intermediate material may be harder or more resilient than the tip 24.

Figure 4:
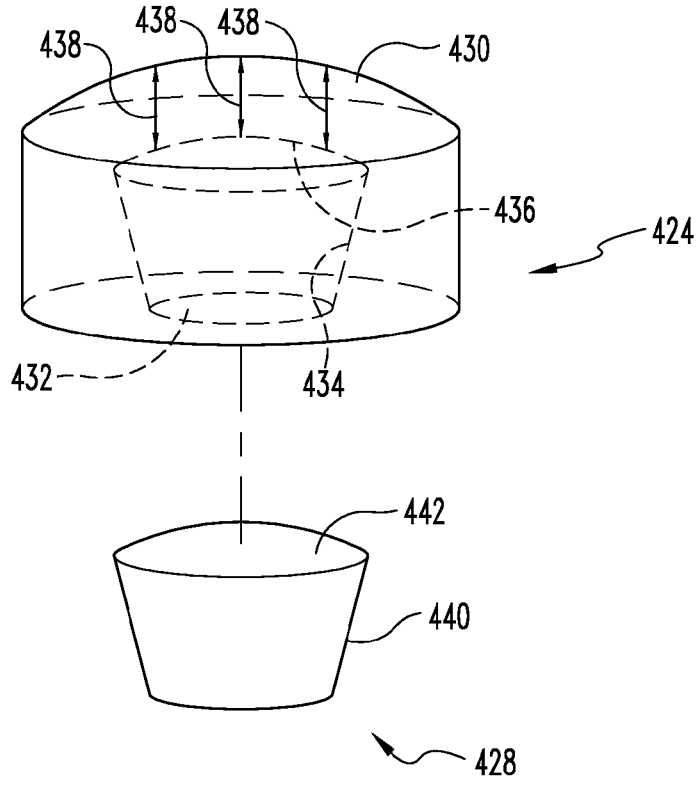
FIG. 4 is an exploded view of the cue tip stabilizer and cue tip of another embodiment according to this invention.

Alternatively, as shown in FIG. 4, the width of tip shape cavity 432 can vary within cue tip 424 by changing the shape of the walls. For example, walls 434 are angled such that the width of tip shape cavity 432 is at its largest where the walls 434 meet striking support surface 436. The cue tip stabilizer could also have a corresponding shape. For example, in FIG. 4, tip stabilizer 428 has angled sides 440 such that the widest part of tip stabilizer 428 is at striking support surface 442.

Figure 5A:
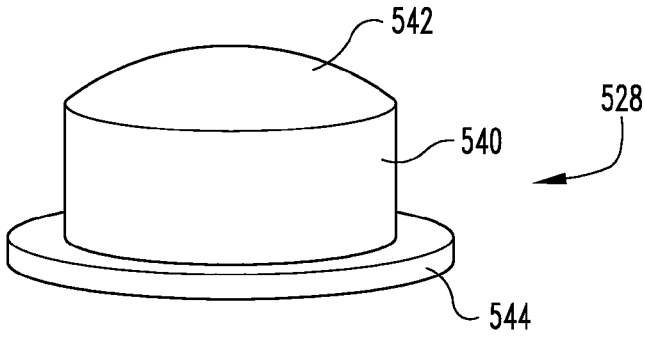
FIG. 5*a* is a perspective view of a cue tip stabilizer according to yet another embodiment of this invention.
Figure 5B:
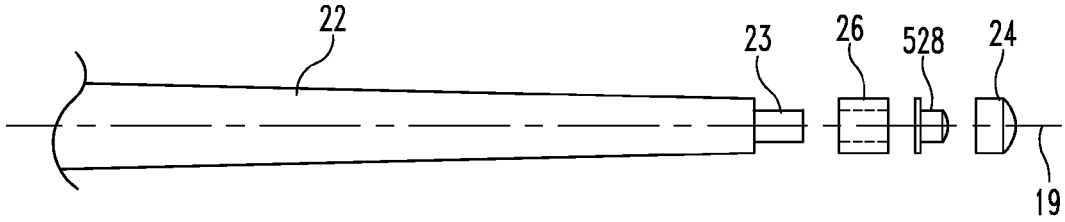
FIG. 5*b* is a side exploded view of a billiard cue with the FIG. 5*a* embodiment.
Figure 5C:
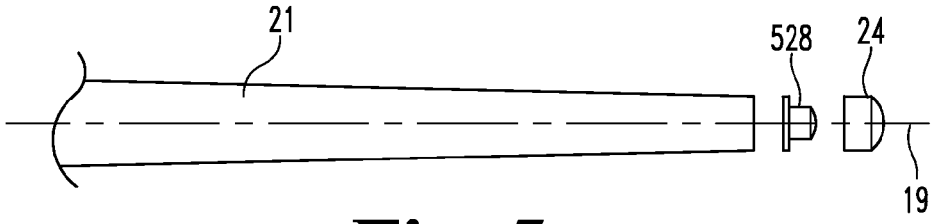
FIG. 5*c* is a side exploded view of a billiard cue without a ferrule with the FIG. 5*a* embodiment.

Referring to FIG. 5*a*, cue tip stabilizer 528 may have a backing plate 544 to facilitate attaching tip stabilizer 528 to shaft 12. For example, backing plate 544 has an outer diameter that is equal to the outer diameter of ferrule 26 or shaft 11 such that the outer surface of an assembled billiard cue is smoothly tapered. FIGS. 5*b* and 5*c* show cue tip stabilizer 528 incorporated into a billiard cues with ferrule 26 (FIG. 5*b*) and without ferrule 26 (FIG. 5*c*). Alternatively, tip stabilizer 528 and backing plate 544 are combined in a single, homogenous component.

Figure 6A:
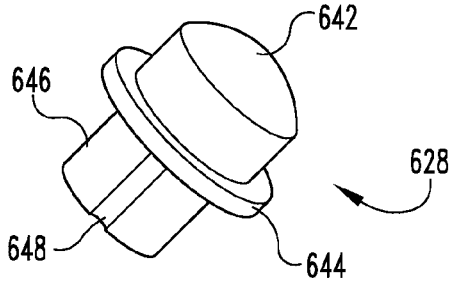
FIG. 6*a* is a perspective view of a cue tip stabilizer according to another embodiment.
Figure 6B:
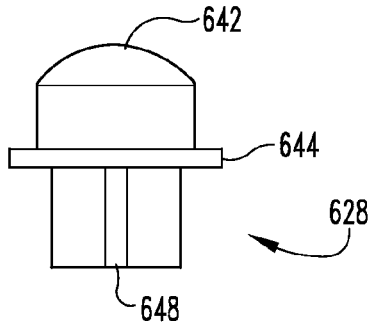
FIG. 6*b* is a side view of the embodiment shown in FIG. 6*a*.
Figure 6C:
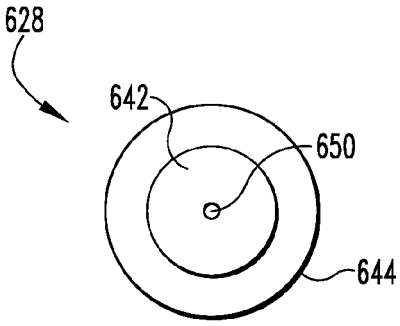
FIG. 6*c* is a top view of the embodiment shown in FIG. 6*a*.
Figure 6E:
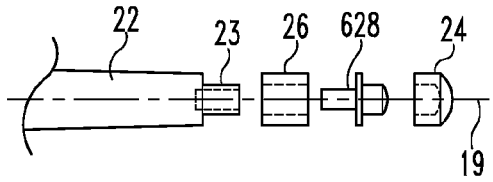
FIG. 6*e* is an exploded side view of a billiard cue with a ferrule and with the embodiment shown in FIG. 6*a*.
Figure 6D:
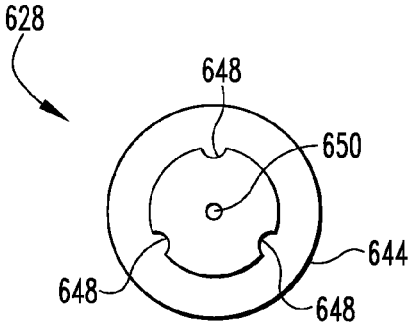
FIG. 6*d* is a bottom view of the embodiment shown in FIG. 6*a*.
Figure 6F:
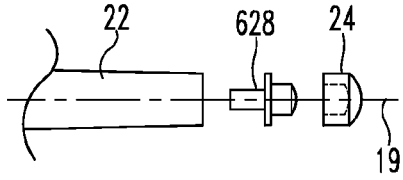
FIG. 6*f* is an exploded side view of a billiard cue without a ferrule and with the embodiment shown in FIG. 6*a*.

Another embodiment for cue tip stabilizer is shown in FIGS. 6*a*, 6*b*, and 6*c*. Cue tip stabilizer 628 includes backing plate 644. Appendage 646 extends from backing plate 644. A number of channels 648 extend along appendage 646. The channels 648 may accommodate adhesive used to secure appendage 646 into the billiard shaft. A through hole 650 is also provided in stabilizer 628 to accommodate excessive adhesive provided between surface 642 and the cue tip 24. Hole 650 provides a path that extends from the surface 642 entirely through appendage 646. FIG. 6*d* illustrates the assembly of billiard cue with cue tip stabilizer 628 and ferrule 26. FIG. 6*e* illustrates the assembly of a billiard cue with cue tip stabilizer 628 but without ferrule 26.

Alternatively appendage 646 is threaded and is removably attached to shaft 21 or ferrule 26. Thus, the assemblage comprising the cue tip 24, tip stabilizer 628, backing plate 644, and appendage 646 may be removably connected to shaft 21 or ferrule 26. It is further contemplated that backing plate 644 include multiple appendages and the shaft 21 or ferrule 26 have multiple corresponding recesses for receiving each appendage.

Figure 7A:
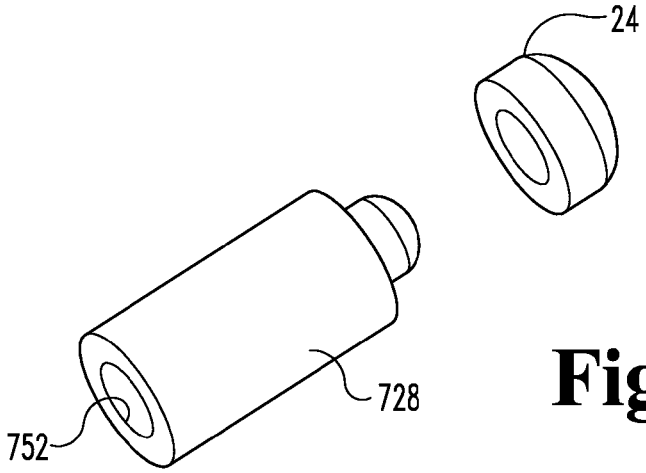
FIG. 7*a* is a perspective view of a cue tip stabilizer according to another embodiment.
Figure 7B:
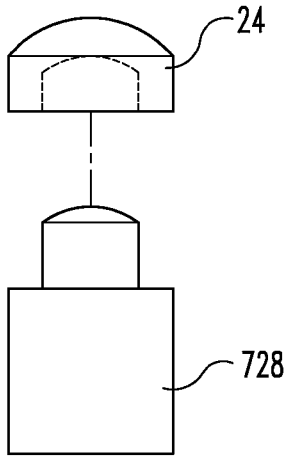
FIG. 7*b* is a side view of the embodiment shown in FIG. 7*a*.
Figure 7C:
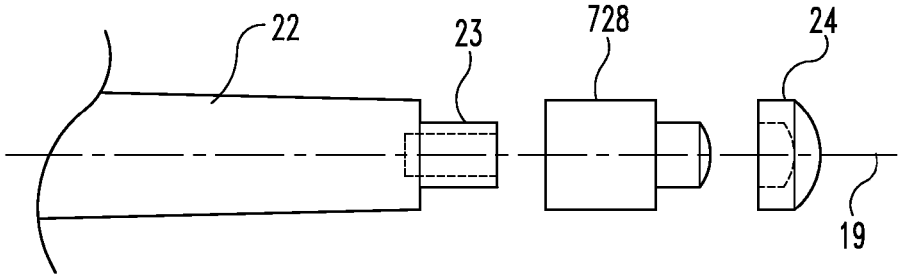
FIG. 7*c* is a side exploded view of a billiard cue with the embodiment shown in FIG. 7*a*.

In the embodiment shown in FIGS. 7*a* and 7*b*, cue tip stabilizer 728 also acts as a ferrule. Cue tip stabilizer 728 can be a homogenous component or can be made by attaching cue tip stabilizers 28, 528, or 628 to ferrule 16. As shown in FIG. 7*c*, billiard cue 720 is assembled by combining cue tip stabilizer 728 to shaft 22 in the same manner that a ferrule is connected to shaft 22. Cue tip 24 is attached to cue tip stabilizer 728. Alternatively, portion 23 of shaft 22 and tip stabilizer recess 752 are threaded which allows cue tip stabilizer 728 and cue tip 24 to be removably connected to shaft 22.

It is to be understood that what has been described is a novel billiard cue comprising a billiard shaft (such as 21, 22) having a longitudinal axis (such as axis 19), a handle end and a tip end. At the tip end, a cue tip stabilizer (such as 28, 428, 528, 628, 728) receives a cue tip (such as 24, 424). The stabilizer has a convex mounting surface (such as 42, 442, 542, 642) that is preferably harder than the cue tip material. The stabilizer is sized to be received at least partially within a cavity of the cue tip, and the stabilizer has a dimension (D2) relative to the longitudinal axis that is smaller than the corresponding dimension (D1) of the adjacent part (i.e. the tip end) of the shaft.

The stabilizer may be integral with or attached to the end of the billiard shaft. A variety of means may be employed for coupling the stabilizer to the billiard shaft. For example, one of the shaft or the stabilizer may include a post or other extension member that is received in a corresponding opening in the other. The extension member may be threaded, configured for friction fitting and/or attached with adhesives.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. All publications, patents, and patent applications cited in this specification, including the related provisional application noted above, are incorporated by reference to the extent not inconsistent with the present disclosure. However, statements in the provisional application regarding the relative importance, or even criticality, of certain features are not intended to limit the present claims, unless such features are explicitly recited in a particular claim. Further, the specifics of the present description and the attached drawings should not be interpreted to limit the scope of this invention to any specifics thereof. Rather, the scope of this invention should be evaluated with reference to the claims appended hereto.

What is claimed is:

1. A billiard cue comprising:

a billiard shaft having a longitudinal axis and a first end, the first end having a first dimension relative to the longitudinal axis; and a rigid cue tip stabilizer for receiving a cue tip at the first end of the shaft, the stabilizer having a convex surface that extends across the longitudinal axis and has a dimension relative to the longitudinal axis that is less than the first dimension, wherein the convex surface is configured to reduce the tendency of the cue tip to become distorted by repetitive use;

wherein the stabilizer is integrally formed with a backing plate that extends entirely across the first end;

wherein a perimeter edge of the convex surface is spaced from the backing plate and the stabilizer has a sidewall that extends from the backing plate to the perimeter edge of the convex surface.

2. The billiard cue of claim 1 further comprising a cue tip defining a receiving cavity, the cue tip being mounted on the stabilizer with the receiving cavity facing the convex surface of the stabilizer, the cue tip being constructed of a material more resilient than at least the convex surface of the stabilizer.

3. The billiard cue of claim 2 wherein the receiving cavity has a concave surface with a curvature that corresponds to the curvature of the convex surface of the stabilizer.

4. The billiard cue of claim 3 wherein the shaft includes a ferrule.

5. The billiard cue of claim 1 wherein the shaft includes a ferrule.

6. The billiard cue of claim 1 further comprising an appendage extending from the cue tip stabilizer for coupling the cue tip stabilizer to the shaft.

7. The billiard cue of claim 6 wherein the cue tip stabilizer includes an opening in the convex surface for accommodating the flow of adhesive.

8. The billiard cue of claim 6 further comprising longitudinally extending grooves along the appendage for accommodating adhesive.

9. A cue tip assembly in combination with a backing plate, the cue tip assembly consisting essentially of:

a cue tip stabilizer defining a convex mounting surface supported by a base, wherein the base extends from a backing plate to the periphery of the convex mounting surface, wherein the mounting surface and the base and the backing plate are integrally formed of synthetic material; and a cue tip mounted on the stabilizer, the cue tip defining a ball striking surface and a mounting cavity, the mounting cavity receiving the mounting surface of the stabilizer and having a concave surface facing the convex mounting surface of the tip stabilizer;

wherein at least the mounting surface of the stabilizer is harder than the cue tip and is effective to reduce the tendency of the ball striking surface to become deformed from repetitive use; and wherein the perimeter edge of the backing plate is not covered by the cue tip.

10. The cue tip assembly of claim 9 further comprising an appendage extending from the backing plate for attaching the cue tip assembly to a billiard shaft.

11. The cue tip assembly of claim 9 further comprising a ferrule; and the cue tip stabilizer is attached to the ferrule.

12. The cue tip assembly of claim 9 wherein the ball striking surface of the cue tip is curved.

13. The cue tip assembly of claim 12 wherein a radius of curvature of the ball striking surface is within about 10% of a radius of curvature of the convex surface of the cue tip stabilizer.

14. The cue tip assembly of claim 10 wherein the stabilizer base defines a generally cylindrical sidewall extending from the backing plate to the periphery of the convex mounting surface.

15. The cue tip assembly of claim 13 wherein the thickness of the cue tip between the ball striking surface and the concave interior surface of the cue tip cavity is substantially constant over the majority of the concave interior surface.

16. A billiard cue comprising:

a shaft with a first end, a second end, and a longitudinal axis;

a cue tip stabilizer comprising a base integrally formed with and extending from a backing plate at the first end of the shaft, the stabilizer base defining a circumferential sidewall that extends from the backing plate to the periphery of a rigid convex exterior surface that extends across the longitudinal axis of the shaft; and a cue tip mounted on the stabilizer but not covering a perimeter edge of the backing plate, the cue tip defining a cavity having a concave interior surface facing the convex exterior surface of stabilizer;

wherein, when the billiard cue is repeatedly used to strike a billiard ball, the concave interior surface of the cue tip is compressed against and stabilized by the convex exterior surface of the stabilizer so as to reduce the tendency of the cue tip to become distorted by repetitive use.

17. The billiard cue of claim 16 wherein the stabilizer comprises a synthetic material.

18. The billiard cue of claim 16 wherein the shaft includes a ferrule about the first end.

19. The billiard cue of claim 17 wherein the cue tip is adhesively affixed to the stabilizer.

20. The billiard cue of claim 19 wherein the convex exterior surface includes an opening to at least one adhesive exit path for accommodating adhesive used to couple the cue tip to the stabilizer.

21. A method for constructing a billiard cue tip comprising:

providing a cue tip defining a mounting cavity opposite a ball striking surface;

providing a cue tip stabilizer integrally formed with a backing plate, wherein the stabilizer comprises a convex exterior surface supported above the backing plate by a base which extends to the periphery of the convex exterior surface; and mounting the cue tip to the stabilizer by placing the exterior surface of the stabilizer inside the mounting cavity of the cue tip while leaving a perimeter edge of the backing plate exposed;

wherein the convex exterior surface of the stabilizer is effective to reduce the tendency of the cue tip to become distorted from repetitive use.

22. The method of claim 21 further comprising providing an adhesive material in the cavity prior to mounting the cue tip to the stabilizer.

23. The method of claim 21 further comprising attaching the stabilizer to a billiard cue by placing the backing plate against the end of the cue with the perimeter of the backing plate aligned with the adjacent outer surface of the cue.

24. The method of claim 23 wherein the attaching includes positioning a mounting member extending from the backing plate inside a recess of the billiard cue.

25. The method of claim 21 wherein at least the mounting surface of the stabilizer is more rigid than the cue tip to reduce the tendency of the cue tip to deform during use.

* * * * *